US006983712B2

(12) United States Patent
Cottrell et al.

(10) Patent No.: US 6,983,712 B2
(45) Date of Patent: Jan. 10, 2006

(54) OFFLOADING ARRANGEMENTS AND METHOD FOR SPREAD MOORED FPSOS

(75) Inventors: Roy H. Cottrell, Cypress, TX (US); Rick A. Hall, Houston, TX (US); Brent A. Salyer, Cypress, TX (US); Caspar N. Heyl, Houston, TX (US); Richard H. Gunderson, Spring, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/211,089

(22) Filed: Aug. 2, 2002

(65) Prior Publication Data

US 2003/0061980 A1 Apr. 3, 2003

Related U.S. Application Data

(60) Provisional application No. 60/309,853, filed on Aug. 3, 2001.

(51) Int. Cl.
*B63B 21/00* (2006.01)

(52) U.S. Cl. ..... 114/230.15; 114/293

(58) Field of Classification Search ..... 441/3, 441/4, 5; 114/230.1, 230.13, 230.14, 230.15, 114/230.16, 230.17, 230.18, 230.19, 263, 114/293

See application file for complete search history.

(56) References Cited

U.S. PATENT DOCUMENTS 3,155,069 A * 11/1964 Ross et al. ..... 114/230.19
3,311,142 A * 3/1967 Bergstrom ..... 141/388
3,354,479 A * 11/1967 Koppenol et al. ..... 441/5
3,442,245 A 5/1969 Christians et al.
3,466,680 A 9/1969 Schirtzinger
3,500,484 A * 3/1970 Erzen ..... 114/230.14
3,519,036 A * 7/1970 Manning ..... 141/387
3,522,787 A * 8/1970 Tam ..... 114/230.16
3,535,883 A * 10/1970 Manning ..... 441/4
3,783,816 A * 1/1974 de Chassy et al. ..... 114/230.15

(Continued)

FOREIGN PATENT DOCUMENTS

GB 2335723 9/1995

(Continued)

*Primary Examiner*—Andrew D. Wright
(74) *Attorney, Agent, or Firm*—Gary L. Bush; Andrews Kurth LLP

(57) ABSTRACT

A mooring arrangement between a floating storage body spread moored in deep water and a shuttle tanker, the arrangement including a single point buoyant member that is adapted for mooring a shuttle tanker in offloading position relative to a floating production, storage and offloading vessel (FPSO) with a link between the floating storage body and the single point buoyant member. One embodiment (100) of the invention employs a submerged yoke (30), having one end (31) rotatably coupled to a FPSO (10) and a second end (32), supported by a buoy. A mooring hawser (28) extends from the buoy to the shuttle tanker and product hoses connect the shuttle tanker with the FPSO and extend along the submerged yoke. In another embodiment, the mooring buoy is stationed by a hold-back mooring system (303–304) and the FPSO or the tanker or both is provide with traction device (308) to move the tanker into loading position with respect to the FPSO. Other embodiments of the invention establish mooring of a shuttle tanker so that it can weathervane 360 degrees during offloading activity. In another embodiment, the mooring buoy (600) is provided with a dynamic positioning system (614) for controlling shuttle tanker positioning with respect to conditions of the environment or for moving the tanker to a desired position during loading.

12 Claims, 9 Drawing Sheets

U.S. PATENT DOCUMENTS

| | | | | | |
|---|---|---|---|---|---|
| 3,916,812 | A | * | 11/1975 | Bartels | 114/230.15 |
| 3,999,498 | A | * | 12/1976 | Flory | 114/39.23 |
| 4,148,107 | A | | 4/1979 | Karl et al. | |
| 4,254,522 | A | | 3/1981 | van Heijst | |
| 4,279,543 | A | | 7/1981 | Remery | |
| 4,290,158 | A | | 9/1981 | Kuntz, Jr. | |
| 4,359,011 | A | * | 11/1982 | Lyles | 114/230.19 |
| 4,406,636 | A | | 9/1983 | Van Heijst et al. | |
| 4,423,984 | A | | 1/1984 | Panicker et al. | |
| 4,441,448 | A | * | 4/1984 | Hillberg | 441/3 |
| 4,530,302 | A | | 7/1985 | Pederson | |
| 4,533,332 | A | | 8/1985 | Coppens et al. | |
| 4,534,740 | A | | 8/1985 | Poldervaart | |
| 4,606,294 | A | * | 8/1986 | Di Tella et al. | 114/230.14 |
| 4,821,804 | A | * | 4/1989 | Pierce | 166/367 |
| 5,065,687 | A | | 11/1991 | Hampton | |
| 5,159,891 | A | | 11/1992 | Lohr et al. | |
| 5,288,253 | A | | 2/1994 | Urdshals et al. | |
| 5,354,151 | A | | 10/1994 | Giannesini | |
| 5,480,264 | A | | 1/1996 | Hunter | |
| 5,505,560 | A | | 4/1996 | Brown et al. | |
| 5,505,646 | A | | 4/1996 | Poldervaart et al. | |
| 5,639,187 | A | | 6/1997 | Mungall et al. | |
| 5,885,028 | A | | 3/1999 | Blanchard et al. | |
| 5,941,746 | A | | 8/1999 | Isnard et al. | |
| 6,109,989 | A | | 8/2000 | Kelm et al. | |
| 6,170,424 | B1 | | 1/2001 | Boerseth | |
| 6,517,290 | B1 | * | 2/2003 | Poldervaart | 405/224.2 |
| 2001/0029879 | A1 | | 10/2001 | Cottrell et al. | |

FOREIGN PATENT DOCUMENTS

| | | |
|---|---|---|
| GB | 2328196 | 2/1999 |
| GB | 2 335 723 A | 9/1999 |
| GB | 2351724 | 1/2001 |
| WO | WO 00/641732 | 11/2000 |
| WO | WO 00/75008 | 12/2000 |
| WO | WO 00/64732 | 11/2002 |

* cited by examiner 300
301
302
303
304
305
306
307
308
309
310
311
312
313
315
316
317
318
319
320
321
330
S FIG. 4A
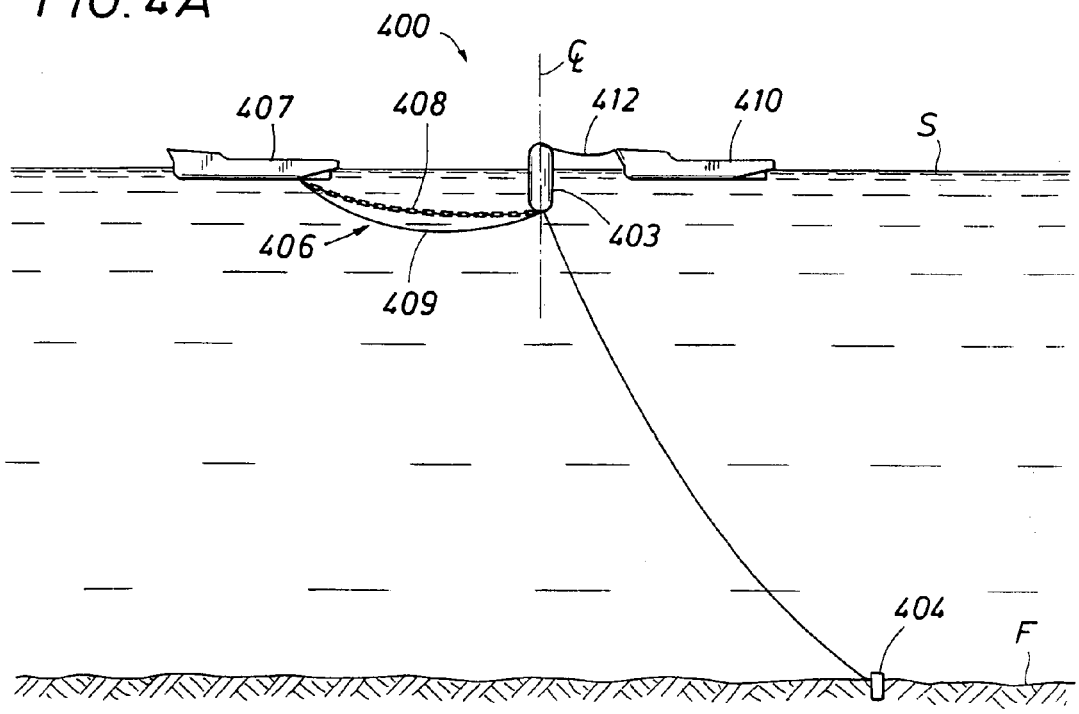
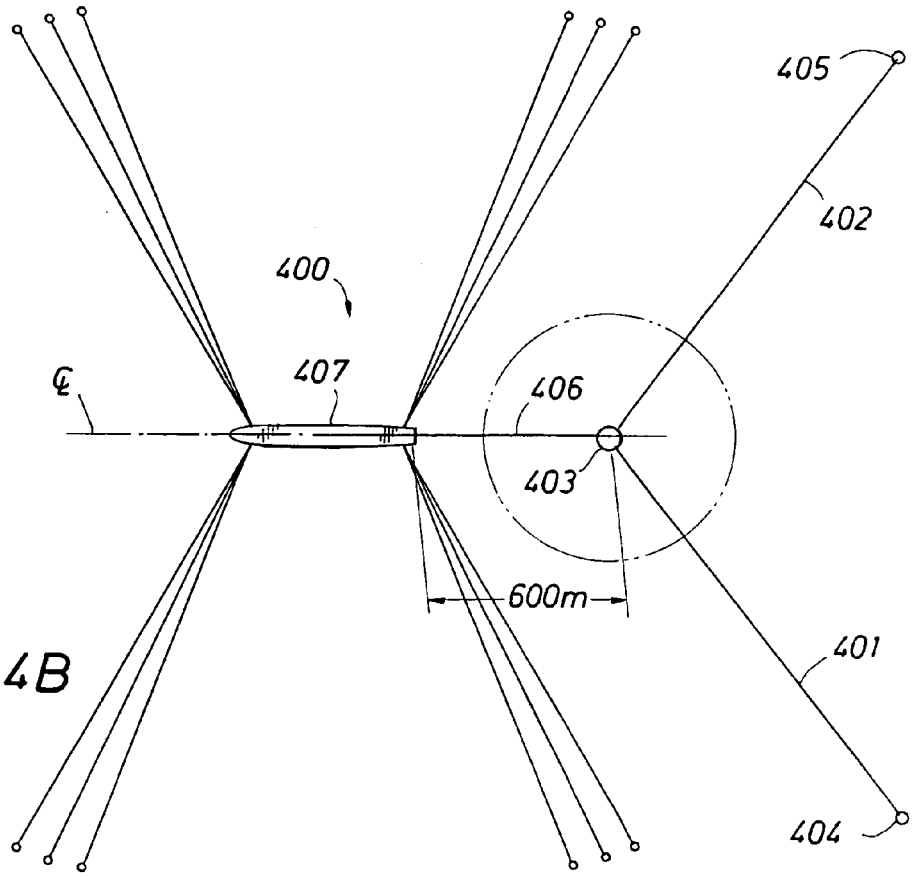
FIG. 4B FIG. 7A
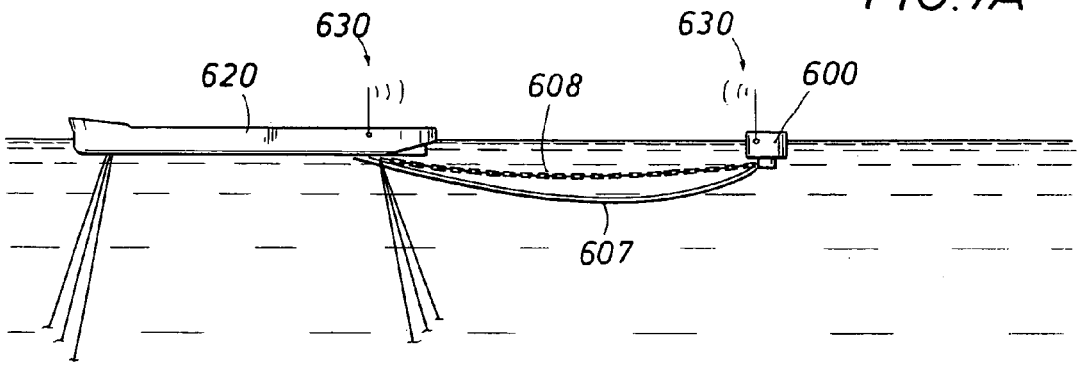
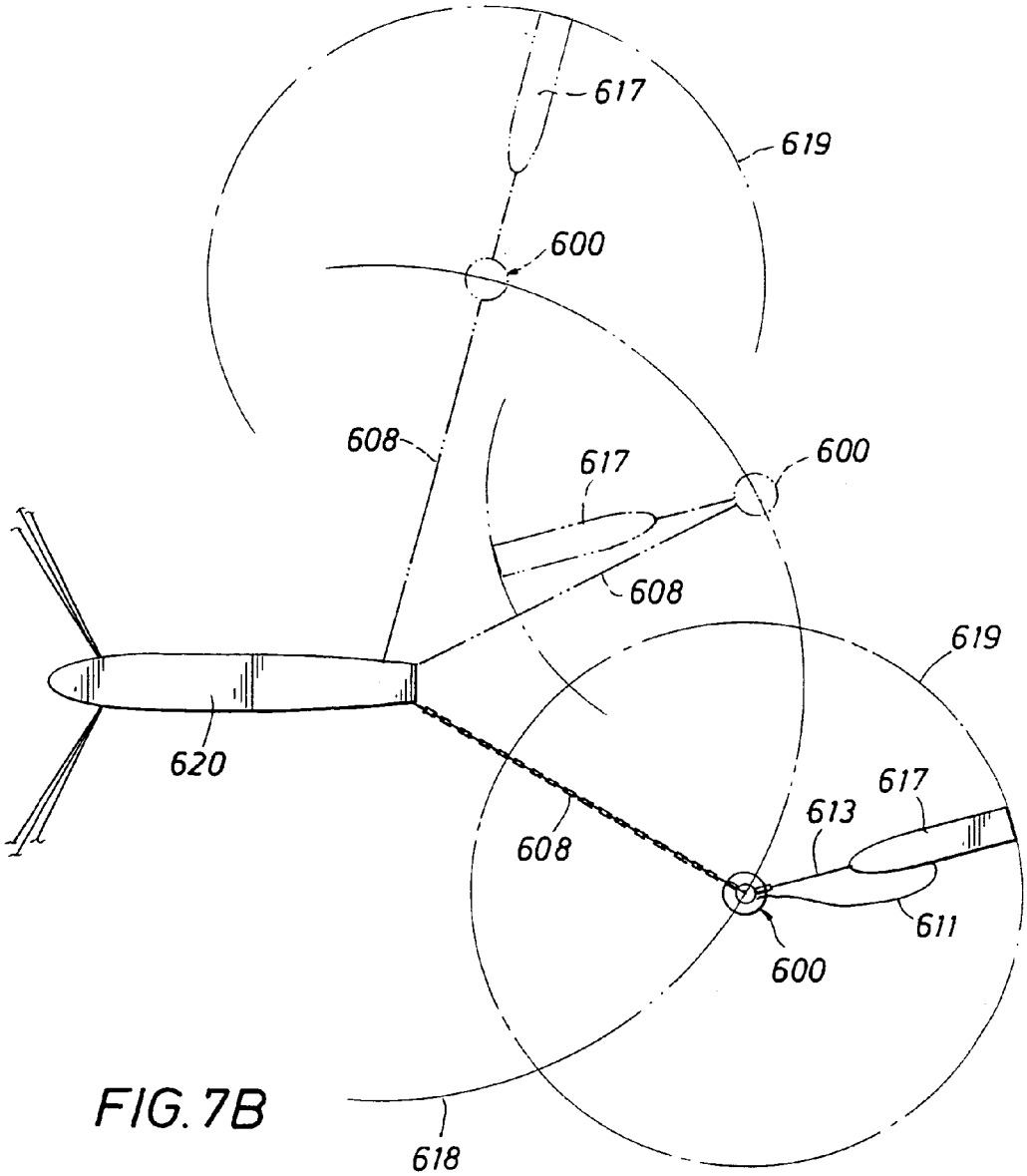
FIG. 7B FIG. 7C
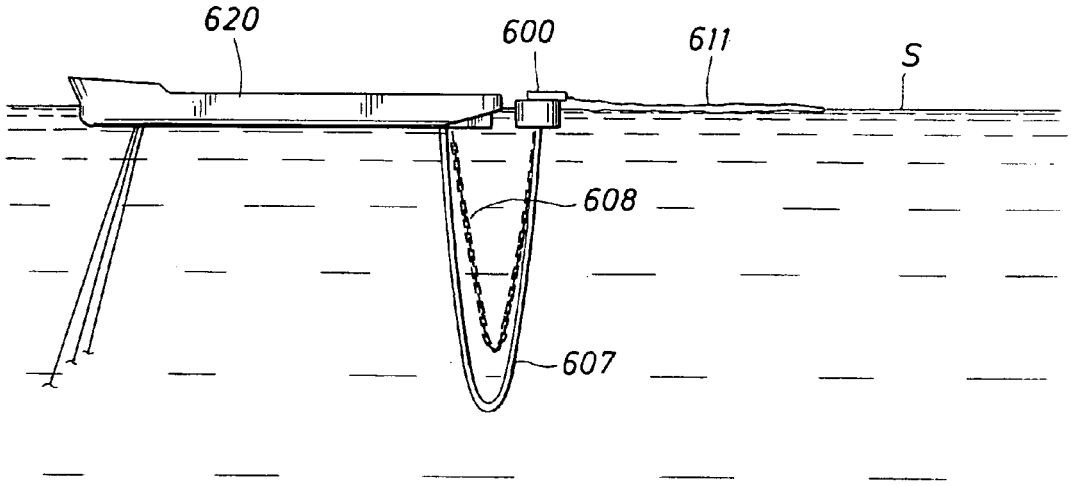
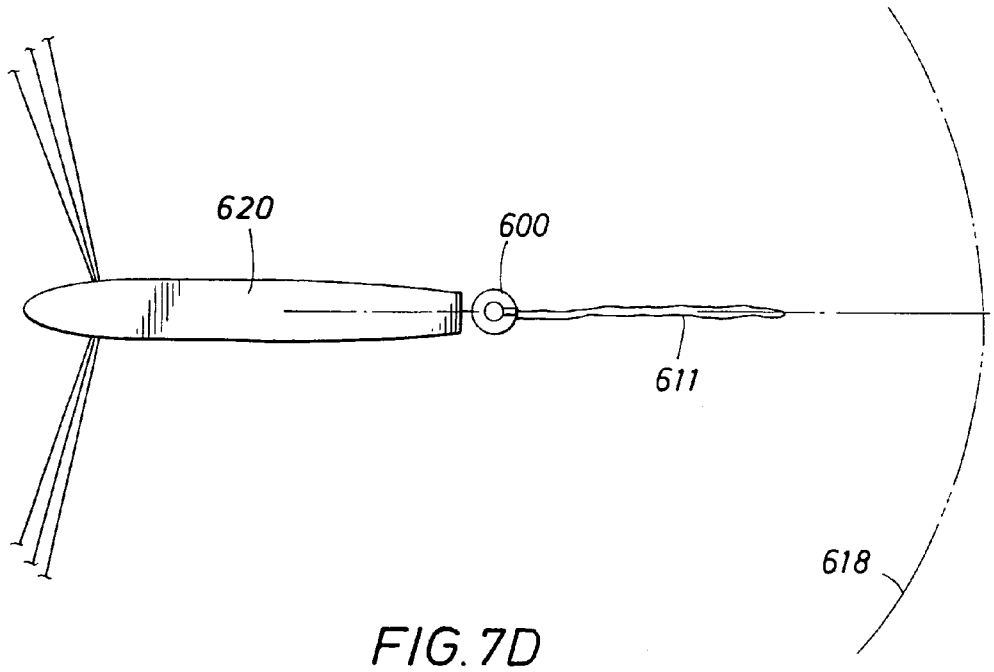
FIG. 7D

OFFLOADING ARRANGEMENTS AND METHOD FOR SPREAD MOORED FPSOS

RELATED APPLICATION

This application claims the benefit of U.S. Provisional Patent Application Ser. No. 60/309,853, filed Aug. 3, 2001 by Roy H. Cottrell, Rick A. Hall, Brent A. Salyer, Caspar N. Heyl and Richard H. Gunderson and entitled "Offloading Arrangements and Methods For Spread Moored FPSOs", which provisional application is incorporated by reference herein for all purposes.

BACKGROUND OF THE INVENTION

1. Field of the Invention

This invention relates generally to mooring systems for offshore terminals and in particular to offloading apparatus and methods for spread moored FPSOs (floating production storage and offloading vessels).

2. Description of the Prior Art

The spread mooring of FPSO vessels with offloading by tandem connection of a shuttle tanker is well-known in the prior art. Prior art tandem connection of a shuttle tanker to an FPSO for hydrocarbon offloading are characterized by several problems:

(1) The limited sector available to the shuttle tanker for unloading at the bow or stem of the vessel (centerline dead astern or dead ahead to ±30 degrees to port or starboard).

(2) The proximity between the shuttle tanker and the FPSO required for tandem offloading, during approach and offloading with the possibility of collision in severe weather.

(3) The FPSO's inability to weathervane.

(4) The magnitude of potential damage in the event of collision.

(5) The cost of maintaining the shuttle tanker within the safe unloading zone during offloading.

(6) The cost of assisting the shuttle tanker during approach to the FPSO.

Summing up, prior offloading systems and methods for tandem offloading from a spread moored vessel to a shuttle tanker results in collision risk and unloading downtime risk.

To reduce risks, prior art systems are known which provide an SPM (Single point Mooring) terminal at a distance of 2000 meters from the FPSO for offloading. Such an arrangement permits weathervaning of the shuttle tanker, eliminates proximity to the FPSO, reduces the cost of collision between the shuttle tanker and the terminal, and minimizes the cost of shuttle tanker assistance.

Such prior art spread moored FPSO offloading systems and methods have provided an independent SPM for a shuttle tanker such as a CALM buoy located a long distance (usually about 2000 meters) from the FPSO in order that a shuttle tanker not contact the FPSO. A flow line, such as a steel pipeline, is run from the FPSO to the CALM buoy. A hose is then run, via a rotatable fluid coupling, to the shuttle tanker which is moored to the CALM buoy by means of a mooring hawser. Fatigue problems (due to constant movement of the sea surface) in the pipe line where it connects to the CALM buoy have been overcome by terminating the pipeline at a submerged Flowline Termination Buoy (FTB). A flexible hose is run from the pipeline end at the FTB to the CALM buoy.

Such prior art systems have provided complete independence of the SPM for the shuttle tanker due to the great distance between the tanker and the FPSO. In other words, the CALM buoy, to which the shuttle tanker is moored, is anchored to the sea floor without any mooring members connected to the FPSO. Unfortunately, in deep water, the cost of the mooring system, SPM terminal, and the fatigue resistant flow line from the FPSO to the FTB is very high and justified only for installations with high throughput and consequent high frequency of offloading with resulting higher risk.

Identification of Objects of the Invention.

The object of this invention is to provide arrangements and methods which overcome the disadvantages identified above.

Another object of the invention is to provide a single point mooring (SPM) for a shuttle tanker where the SPM is controlled directly or indirectly by linkage to a spread moored FPSO, with the result that the disadvantages identified above are overcome.

Another primary object of the invention is to provide a mooring system by which a shuttle tanker is moored to a SALM which is directly linked to a submerged yoke which is pendularly connected to the FPSO such that the shuttle (1) can be moored to an FPSO with the mooring being tolerant to surge conditions of the sea, (2) can accept connections of the shuttle tanker at angles to the longitudinal axis of the FPSO, and (3) can allow weathervaning angles of the shuttle tanker with respect to a spread moored FPSO up to about 300 degrees.

Another object of the invention is to provide a mooring system by which an LNG shuttle tanker is moored to buoyant columns secured to a submerged yoke which is pendularly connected to an LNG/FPSO such that the tanker is (1) surge tolerant, (2) can be moored at angles to the longitudinal axis of the LNG/FPSO and (3) can rotate in an arc about an end of the LNG/FPSO.

Another object of the invention is to provide a mooring system by which a shuttle tanker is moored at one end to a hold back buoy which is indirectly linked to the FPSO by means of a tension member connected between an end of the FPSO and an opposite end of the shuttle tanker, such that the shuttle tanker (1) can move in an arc about the end of the FPSO (2) is prevented from contacting the FPSO by the hold back buoy and (3) can be quickly disconnected from the hold back buoy.

Another object of the invention is to provide a mooring system by which a shuttle tanker is moored to a mooring buoy spaced about 600 meters from the end of the spread moored FPSO, where the mooring buoy is anchored to the sea floor and linked to the FPSO by means of a catenary chain, such that the shuttle tanker can move in a three hundred sixty degree circle about the mooring buoy without contact with the FPSO.

Another object of the invention is to provide a mooring system by which a shuttle tanker is moored to a mooring buoy in the form of a SALM which is connected to a mooring leg group for the FPSO, where the SALM is spaced about 600 meters from the end of the spread moored FPSO, such that the shuttle tanker can weathervane in a three hundred sixty degree circle about the SALM without contact with the FPSO.

Another object of the invention is to provide a mooring system by which a shuttle tanker is moored to a mooring buoy in the form of a Dynamically Positioned buoy, indirectly linked to the FPSO by means of a remote control link and directly linked to the FPSO by means of a mooring line between the DP buoy and the FPSO, where the DP buoy is spaced about 600 meters form the end of the spread moored FPSO, such that the shuttle tanker can weathervane in a three hundred sixty degree circle about the DP buoy and the DP buoy can be positioned in an arc about an end of the FPSO.

SUMMARY OF THE INVENTION

The objects identified above, along with other features and advantages of the present invention, are provided in a mooring system for a shuttle tanker for offloading from a spread moored FPSO type vessel in deep water, where a mooring buoy linked directly and/or indirectly to the FPSO moors the shuttle tanker in close proximity (e.g., about 600 meters or less) from an end of the FPSO. According to a first FPSO offloading arrangement, a shuttle tanker is moored from a FPSO by a submerged yoke where a first yoke end is supported in dependent and moveable relation from an end of a FPSO and a second yoke end is supported in dependent relation from a SALM (Single Anchor Leg Mooring) buoy. The SALM is moored to a second end of the submerged yoke with a mooring hawser connected between the SALM and the shuttle tanker.

According to a second FPSO offloading arrangement for an LNG/FPSO, a submerged yoke is suspended in dependent relation from the LNG/FPSO by flexible links as in the first offloading arrangement. The submerged yoke is provided with spaced buoyant forward and aft columns which also serve as mooring elements to which the LNG/shuttle tanker can be moored. The bow of the LNG/shuttle tanker is moored to the forward buoyant column and the midships of the LNG/shuttle tanker can be moored to the aft buoyant column, with its LNG manifold being located immediately adjacent the aft buoyant column. The aft buoyant column is provided with a loading boom for controlled support and orientation of the LNG offloading hose. In this case, the flexible connection of the submerged yoke to the FPSO permits the submerged yoke and the LNG/shuttle tanker to weathervane about a significant arc even though the spread mooring system of the LNG/FPSO prevents it from weathervaning. This mooring arrangement is not strictly restricted to offloading of LNG products, but may be employed for offloading any of the usual products, for example, crude oil, distillate, etc., without departing from the spirit and scope of the present invention.

In situations where limited weathervane movement of a shuttle tanker is allowed and where controlled non-contact stationing of the shuttle tanker is necessary, a third mooring and offloading arrangement is provided within the scope of the present invention wherein an FPSO is spread moored in deep water. A compliant hold-back buoy, connected to an aft end of the shuttle tanker, is located a distance from one end of the FPSO by a dual diverging leg mooring arrangement and has an operative position and a rest position with respect to the FPSO, the operative position being established as the buoy is moved closer to the FPSO by traction or tension forces applied through this shuttle tanker itself by a traction hawser and traction winch mechanism connected between the FPSO and the bow end of the shuttle tanker. To permit offloading activity, a shuttle tanker is moved into position between the FPSO and the rest position of the hold-back buoy and one of the ends of the shuttle tanker, preferably the aft end, is connected to the hold-back buoy by an anchor chain. An opposite end of the shuttle tanker, typically the bow, is connected to the FPSO by a mooring chain. The mooring chain may be composed entirely of chain material or, if desired, it may have chain ends to permit ease of connection and disconnection, with the chain ends being connected to respective ends of a mooring hawser composed of cable, rope or any other desirable material of high tensile strength. During mooring connection, a pull-in or traction hawser is connected to the shuttle tanker and applies tension or traction force to the mooring chain to move the shuttle tanker slightly closer to the FPSO than the desired mooring position. The tension being applied to the anchor chain also moves the hold-back buoy, which is tethered to the shuttle tanker, from its rest position to an operative position nearer and in substantial alignment with the FPSO. After the shuttle tanker has been pulled to a position slightly closer to the FPSO than the desired offloading position, the mooring chain is connected between the FPSO and the shuttle tanker, and the tension of the traction winch is relaxed, permitting the mooring chain to accept the entire mooring load. In this moored condition, because the hold back buoy mooring is more compliant than the FLSP mooring, the shuttle tanker is allowed to weathervane slightly about its mooring point on the FPSO to remove the mooring loads induced on the system by waves, wind or current not aligned with the longitudinal axis of the FPSO. The traction winch and its traction or tension hawser may be used at any point to apply greater tension to the anchor chain. In this case, the tension that is applied to the anchor chain by the traction winch combined with the stiffness characteristics of the mooring legs determines the amount of weather and current compliant lateral excursion of the shuttle tanker from alignment with the center-line of the FPSO and the hold-back buoy.

A fourth offloading arrangement moors a shuttle tanker to a spread moored FPSO in deep water by locating a Single Point Buoy (SPM) a sufficient distance from the FPSO/SPM such that the shuttle tanker is permitted to weathervane 360 degrees about the SPM. The SPM can be moored by diverging hold-back mooring legs, or even a single hold-back leg, to ensure its minimum spacing with respect to the FPSO. The SPM is typically a buoyant column having its upper end provided with a loading boom or turntable for controlled support and positioning of the offloading hose or hoses through a rotatable coupling and the connection thereof to the fluid handling manifold of the shuttle tanker. A connection chain or other suitable connector links the SPM to the FPSO and maintains the position of the buoy or column and provides protection for an offloading riser between the FPSO and the shuttle tanker. The chain and riser have sufficient catenary shapes to permit the shuttle tanker to pass over them without any potential for contact or interference.

The present invention may take the form of a fifth offloading arrangement where one leg group of the spread mooring legs for the FPSO is modified to permit shuttle tanker mooring to a SALM buoy linked to the FPSO. At a distance sufficient to provide for 360 degree weathervaning movement of a shuttle tanker, a floating column or buoy type SALM is moored by a substantially vertically oriented mooring link, chain or line that is fixed intermediate the length of one of the typically four mooring leg systems of the FPSO. A production fluid flow line from the FPSO extends along and is tethered to the selected mooring leg system, with its remote end terminating at the SALM. The SALM is also provided with a mooring system for weathervane mooring of the shuttle tanker and is provided with handling and control equipment for one or more flow lines that extend, typically along the mooring hawser from the SALM to the flow control manifold system of the shuttle tanker through a rotatable coupling.

For stationing of SPM buoys relative to a moored FPSO, without using hold-back mooring or anchoring systems for the buoys, one or more dynamic positioning buoys, referred to here as DP buoys, are indirectly linked to the FPSO. According to the sixth offloading arrangement of the present invention, a DP buoy having independent on-board power systems and rotatable hawser and hose turntables is controlled directly on the DP buoy or is remotely controlled by the FPSO. A DP buoy may be stationed at a minimum distance (e.g., about 600 meters) from the FPSO that is sufficient to permit substantially 360 degrees rotation of the shuttle tanker about the DP buoy. Likewise, the DP buoy can be operated to be stationed at any location within an arc of about 180 degrees from the point of connection of its catenary mooring tether, line or chain, with the FPSO as urged by the action of wind, waves or currents. The catenary of the mooring line or chain permits the shuttle tanker to pass over it without contact by the shuttle tanker. A flow line or hose extends from the FPSO along the length of the mooring line or chain to the DP buoy and is protected against excess tension force by the mooring line or chain, because the chain is shorter than the flowline. When offloading of a shuttle tanker is not in progress or is imminently expected, the thrusters of the DP buoy can be deenergized, in which case the weight of the mooring line or chain and offloading hose draws the DP buoy to a rest station close to the FPSO. To provide for protection of the FPSO and the DP buoy when the buoy is located at its close-in rest station, the buoy is provided with one or more fenders. The fenders also provide protection for the shuttle tanker in the event of contact with the buoy.

BRIEF DESCRIPTION OF THE DRAWINGS

The invention is described by reference to drawings of which:

FIGS. 4A and 4B are side elevation and plan views of a SALM moored shuttle tanker arranged to weathervane 360 degrees about the SALM while being tethered in production offloading relation with the FPSO;

FIGS. 7A and 7B are side elevation and plan views of a spread mooring of a FPSO utilizing the DP buoy of FIGS. 6A and 6B for dynamically positioning the buoy at a selected safe distance and position relative to the FPSO for 360 degree weathervaning mooring of a shuttle tanker in offloading relation with the FPSO; and FIGS. 7C and 7D are side elevation and plan views of the spread mooring system of FIGS. 6A and 6B and showing the rest position of the DP buoy being drawn close to the FPSO by the weight of the catenary mooring line or chain and the offloading riser.

DESCRIPTION OF THE PREFERRED EMBODIMENTS OF THE INVENTION

Figures 1A, 1B:
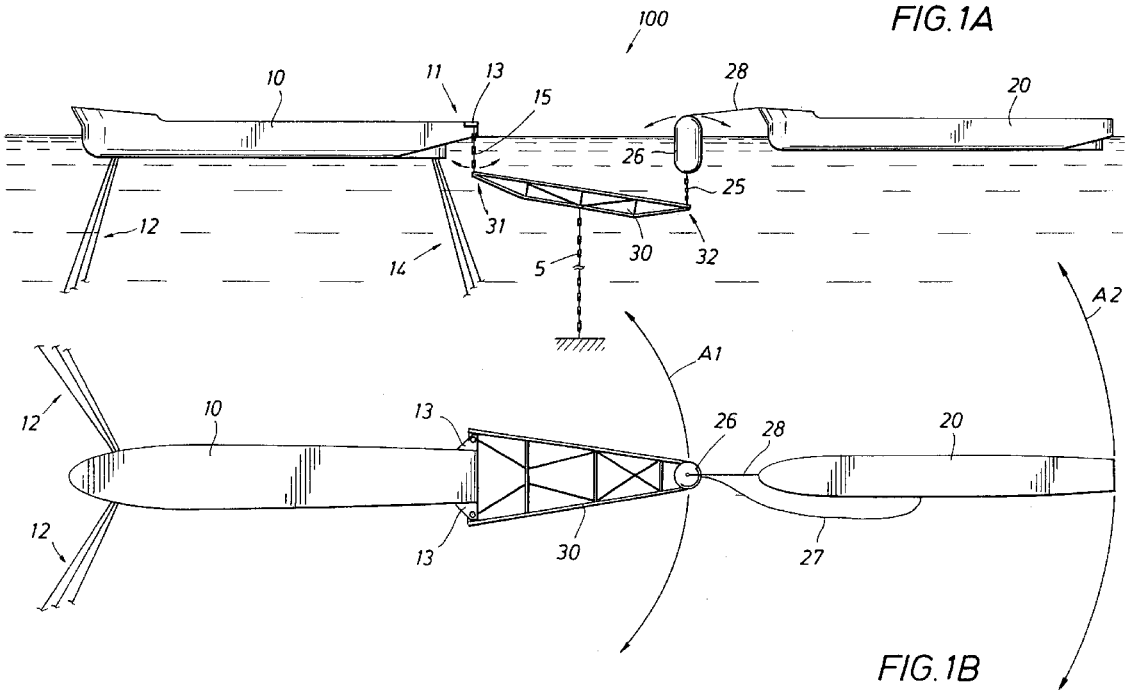
FIGS. 1A and 1B are side and plan views of a spread moored FPSO with a shuttle tanker moored by a submerged yoke to the stem of the FPSO.

As illustrated in FIGS. 1A, 1B, a mooring arrangement 100 is illustrated where a submerged yoke 30 is hung from outriggers 13 located at the unloading end 11 of an FPSO, in a pendular fashion, and is supported at its opposite end by a fendered SALM 26. A shuttle tanker 20 is moored to the SALM 26 by a mooring hawser 28 and loaded in the normal fashion through a floating hose 27 between the SALM 26 and a loading manifold of the shuttle tanker 20. The FPSO's aft mooring legs 14 are keel mounted to avoid interference with the yoke 30 during partial weathervaning.

The submerged yoke 30 is preferably supported at the aft end of the FPSO by two vertical links 15 such as chains or other tension members. Links 15 are connected to outrigger porches 13 and allow the yoke 30 to twist about the end of the FPSO such that fendered SALM 26 can rotate in an arc A1 during weathervaning conditions operating on shuttle tanker 20. The shuttle tanker 20, connected to SALM 26 by the mooring hawser 28, is capable of rotation in an arc depicted as A2 about the SALM 26 as the center of rotation.

The arrangement 100 of FIGS. 1A, 1B is advantageous because it allows partial weathervaning of the shuttle tanker 20 about the SALM 26 and in turn, the yoke 30 about the unloading end 11 of the FPSO 10. This arrangement increases the safe unloading sector from ±30 degrees of prior art systems to ±150 degrees and facilitates a reduction in offloading down time due to non-colinearity of the tanker with the FPSO. Non-colinearity is a term describing the condition where the longitudinal axis of the shuttle tanker 20 is not aligned with that of the FPSO 10 due to environmental force misalignment with the FPSO. A second advantage is that because of the depth of the yoke 30 below the water surface and the use of a fendered SALM 26 as the shuttle tanker 20 mooring point, the likelihood of damage to the shuttle tanker due to shuttle tanker surge into the FPSO is eliminated. Consequently, tug assist during shuttle tanker approach and loading required of prior tandem offloading system is greatly reduced, resulting in a system which is more passive and less costly to operate.

An alternative addition to the arrangement to that of FIGS. 1A, 1B is a single leg 5 stayed or tethered between the yoke 30 and the sea floor for directional stability of the yoke 30 between the FPSO 10 and the SALM buoy 26.

Figure 2A:
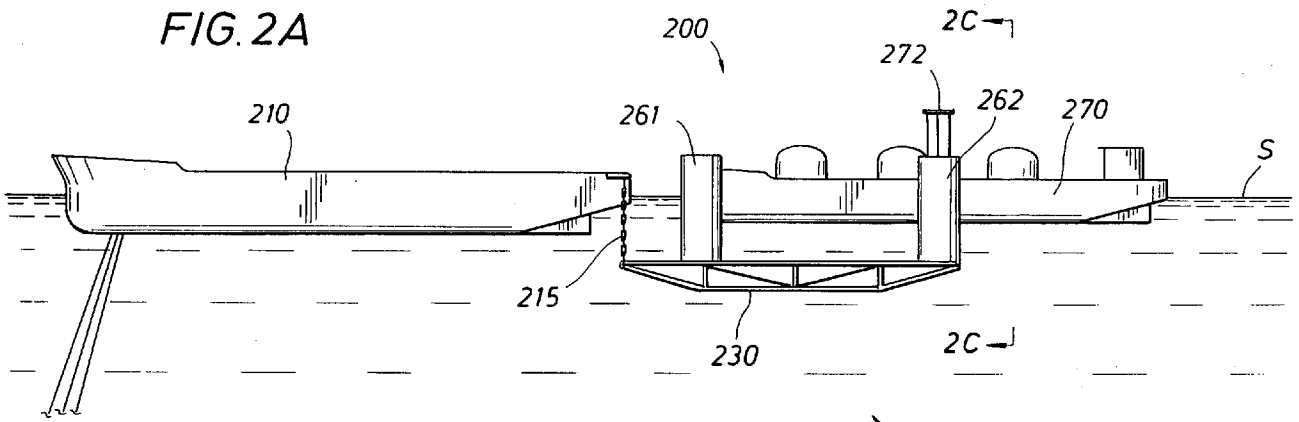
FIGS. 2A and 2B are side and plan views of a spread moored LNG/FPSO with a LNG/shuttle tanker and employing a submerged yoke for close mooring and for production offloading control.
Figure 2B:
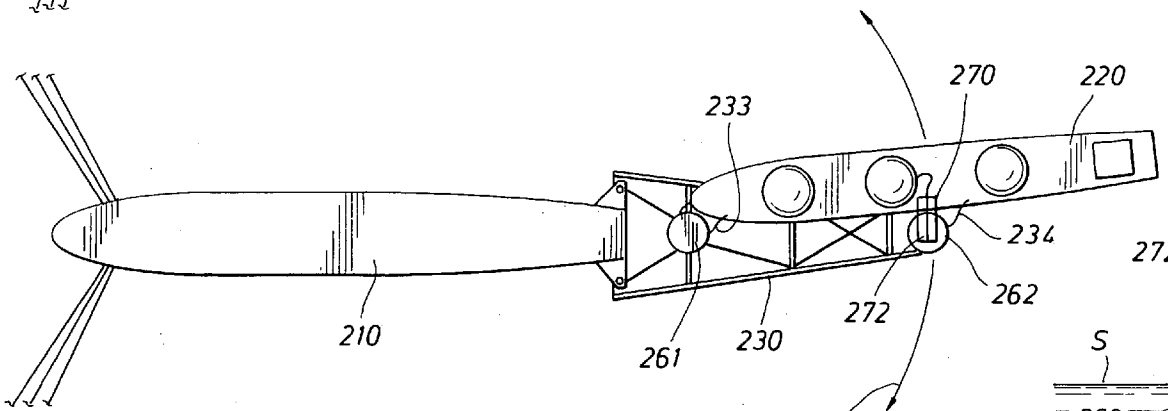
Figure 2C:
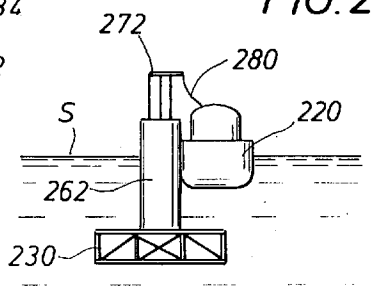
FIG. 2C is a view taken along lines 2C—2C of FIG. 2A and showing the submerged yoke with buoyant columns and LNG offloading system of FIGS. 2A and 2B and showing an LNG shuttle tanker in relation to the surface of the seawater on which the FPSO offloading system is located.

FIGS. 2A, 2B, and 2C illustrate an alternative mooring arrangement 200 of a LNG/FPSO processing vessel 210 with an LNG/shuttle tanker 220. This alternative arrangement is similar to that of FIGS. 1A and 1B in that a submerged yoke 230 is suspended from the end of LNG/FPSO 210 by flexible links 215 which allow an end of the yoke 230 to rotate in an arc 231. Two buoyant vertical columns 261, 262 are mounted on submerged yoke 230 and project above the water surface S to provide for LNG/shuttle tanker 220 mooring and LNG/FPSO 210 offloading. The buoyant column 261 provides a mooring structure to which one end, typically the bow, of an LNG/shuttle tanker 262 is moored when positioned for offloading. The buoyant column 262 is sufficiently spaced from the buoyant column 261 as to provide for mooring of the midship section of the LNG shuttle tanker 262 thereto. Such positioning causes the buoyant column 262 to be located immediately adjacent the midship section of the shuttle tanker 220. An LNG loading boom 272 is mounted on the buoyant column 262. The boom 272 provides support and control for the offloading arm or arms and hose or hoses extending from the LNG/shuttle tanker 220 and along the submerged yoke 230.

The LNG/shuttle tanker 220 is moored by securing bow lines 233 to forward column 261, and aft mooring lines 234 secure the tanker 220 to rear buoyant column 262. A mid ship LNG manifold 270 accepts product via hose 280, shown in FIG. 2C, via LNG loading boom 272 which is in fluid communication with a fluid flow path (not illustrated) via the submerged yoke 230 to the LNG/FPSO 210 or with a marine loading arm (not illustrated). With the shuttle tanker tethered in substantially immovable relation with the submerged yoke 230, the pendent link tethered relationship of the yoke to the FPSO permits the shuttle tanker 220 to weathervane in an arc 231 in the order of about 160 degrees. Thus, the LNG/shuttle tanker 220 has the capability for substantial arcuate excursion relative to the center-line of the LNG/FPSO 210, while maintaining efficient fluid offloading connection with the LNG/FPSO 210 via the product offloading hose 280 or a marine loading arm.

Figures 3A, 3B, 3E:
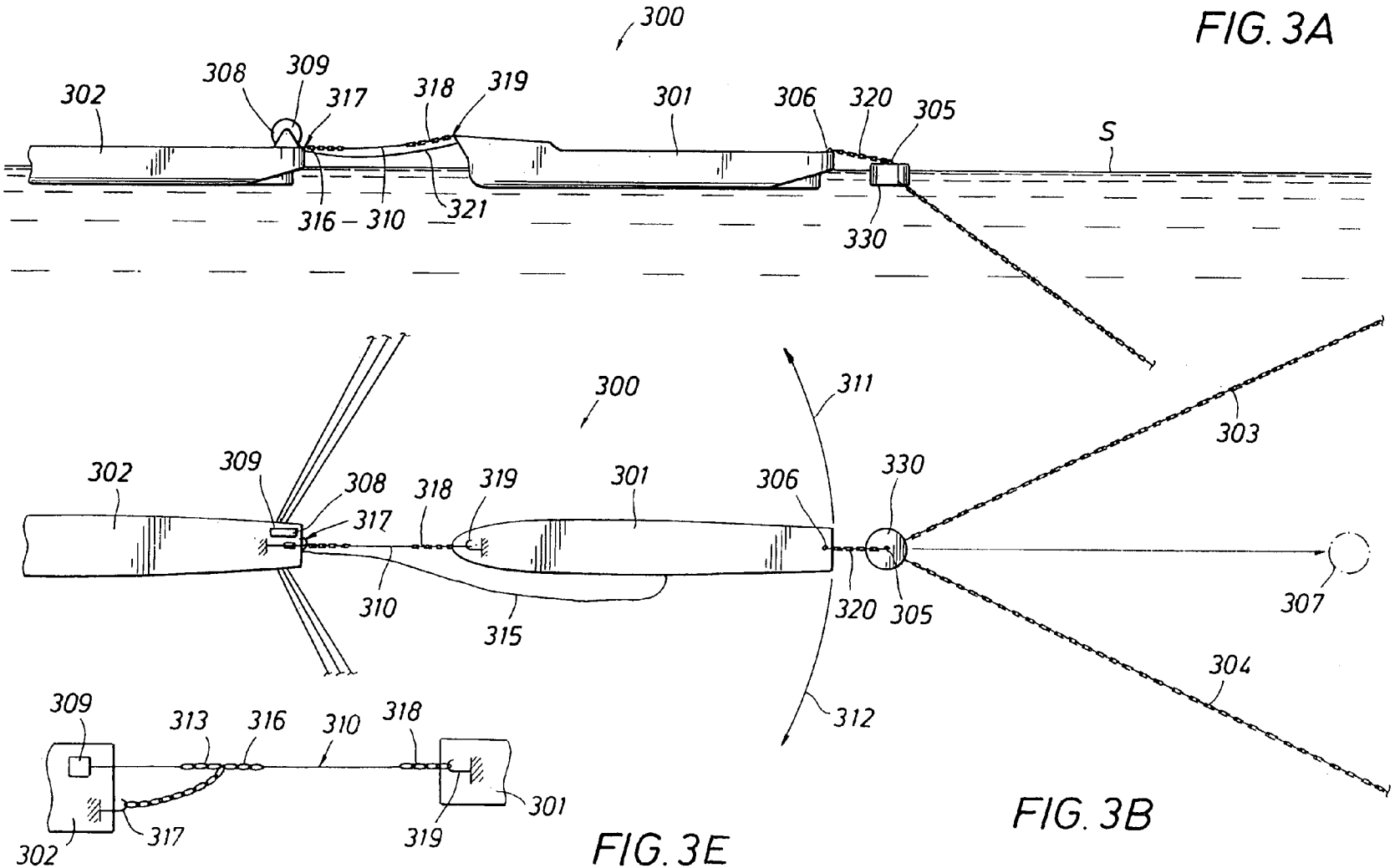
FIGS. 3A and 3B are side elevation and plan views of a spread moored FPSO with a shuttle tanker having a hold-back buoy provided to reduce collision risk between the shuttle tanker and the FPSO and to permit environmental compliant lateral excursion of the shuttle tanker with regard to the tension being applied by a traction winch of the FPSO.
FIG. 3E illustrates connection and release mechanisms by which the shuttle tanker is connected or disconnected from the FPSO.

The spread mooring arrangement 300 of FIGS. 3A and 3B illustrates a moored hold-back buoy 330 for mooring a shuttle tanker 301 between the buoy 330 and a FPSO 302. The hold-back buoy 330 is moored to the sea floor at a predetermined distance away from the FPSO 302 in the direction generally down stream from the prevailing source of environmental forces. A pair of diverging mooring legs 303 and 304 permit the holdback buoy 330 to be stabilized against inadvertent movement. The shuttle tanker 301 or hold-back buoy 330 is fitted with a remotely actuated quick disconnect mooring point, such as shown at 305 or 306, so that the shuttle tanker 301 can be quickly released from its mooring connection with the hold-back buoy 330 if desired. Also, when released from the shuttle tanker 301, the hold-back buoy 330 is moved away from the FPSO 302 by the weight induced force of the mooring legs 303 and 304 or by environmental forces or both and assumes a "rest" position as shown in broken line at 307. The FPSO 302 is fitted with a pull-in winch or traction winch 308 with a hawser storage reel 309 for applying tension or traction force to the mooring hawser 310 and thus pulling the shuttle tanker 301 toward the FPSO 302 after connection of the shuttle tanker 301 to the hold-back buoy 330.

Shuttle tanker loading is typically accomplished by establishing a mooring connection at one end, typically the stem of the shuttle tanker 301 to the hold-back buoy 330, with the hold-back buoy at its rest position 307. The shuttle tanker can then move or be moved toward the FPSO 302, thus causing the mooring legs 303 and 304 of the hold-back buoy 330 to assume the positions shown in FIG. 3B, thus stabilizing one end of the shuttle tanker 301 and permitting its compliant movement within limits determined by the force being applied by the traction winch 308 and the stiffness characteristics of legs 303 and 304.

The FPSO offloading and tanker loading system 300 is designed so that shuttle tanker surge is limited while partial weathervaning of the shuttle tanker about the loading connection at the FPSO is permitted by the compliance of the hold-back buoy mooring configuration. Also, the traction winch tension on the mooring hawser 310 can be simply and efficiently controlled to adjust system reaction to weather or environment induced lateral compliant movement of the shuttle tanker as evidenced by compliant movement arcs 311 and 312. In this way, the hold-back buoy 330 eliminates the need for costly tugs that are normally employed for shuttle tanker hold-back and control during FPSO unloading. Loading the shuttle tanker 301 is accomplished with a floating hose 315 between the FPSO 302 and the shuttle tanker 301 or through a catenary shaped hose 321 suspended from FPSO 302 to shuttle tanker 301.

As the shuttle tanker 301 connects to the hold-back buoy 330 during its approach to the FPSO 302, hold back force with resulting shuttle tanker 301 position control increases as the shuttle tanker 301 nears the FPSO 302. Such control reduces the risk of collision during approach. To pull the shuttle tanker into offloading position, the FPSO traction winch 309 pulls the shuttle tanker 301 toward the FPSO 302. The tension can be released at any time during pull-in to allow the hold back buoy 330, acting in response to the forces of its mooring legs 303, 304, to pull the shuttle tanker 301 away from the FPSO 302 to a safe distance. The hawser 310 connecting the FPSO 302 to the shuttle tanker 301 has a chain section 316 at the FPSO end and a chain section 318 at the shuttle tanker end, such that upon arrival of the shuttle tanker 301 to the desired position relative to the FPSO 302, a hook or stopper 317 on the FPSO 302 is readily connected to the hawser chain 316. The chain section 318 is connected to hook 319 of the shuttle tanker 301. The FPSO winch 309 then slacks off, transferring the load to the chain 316-hawser 310-chain 318 section of the pull-in line. The hook or stopper 317 can be released at any time, enabling the hold-back buoy 330 to pull the shuttle tanker 301 away from the FPSO 302, to a distance of greater safety. The shuttle tanker 301 can be released normally at releasable hook or stopper 319 on shuttle tanker 301 or in an emergency by disconnecting link 313 from hook or stopper 317. See FIG. 3E.

Figure 3C:
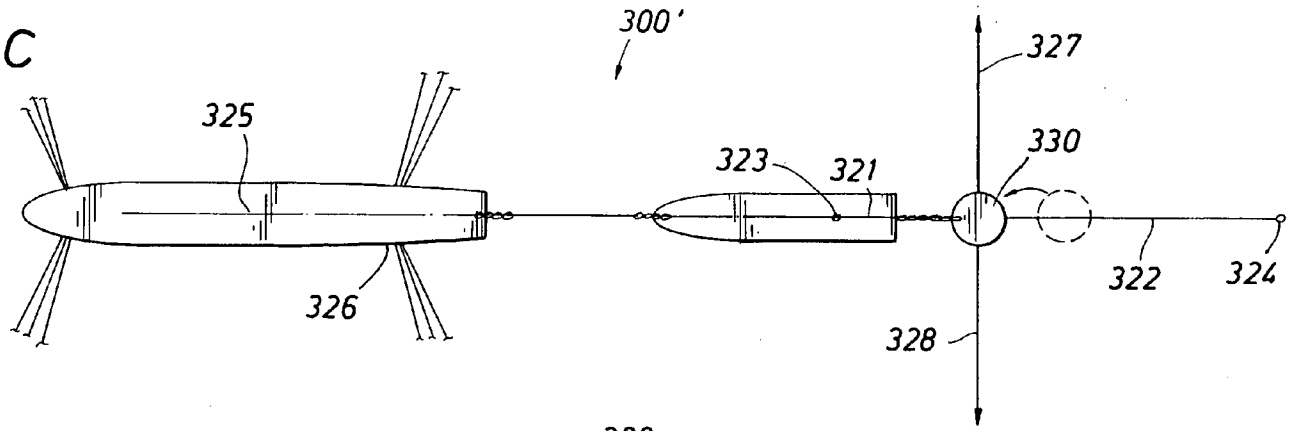
FIGS. 3C and 3D are side elevational and plan views showing an alternative mooring arrangement with dual mooring legs arranged to either side of a buoy or SALM and in alignment with the center-line of the FPSO for permitting environmental compliant movement of the buoy while maintaining predetermined spacing with the FPSO.
Figure 3D:
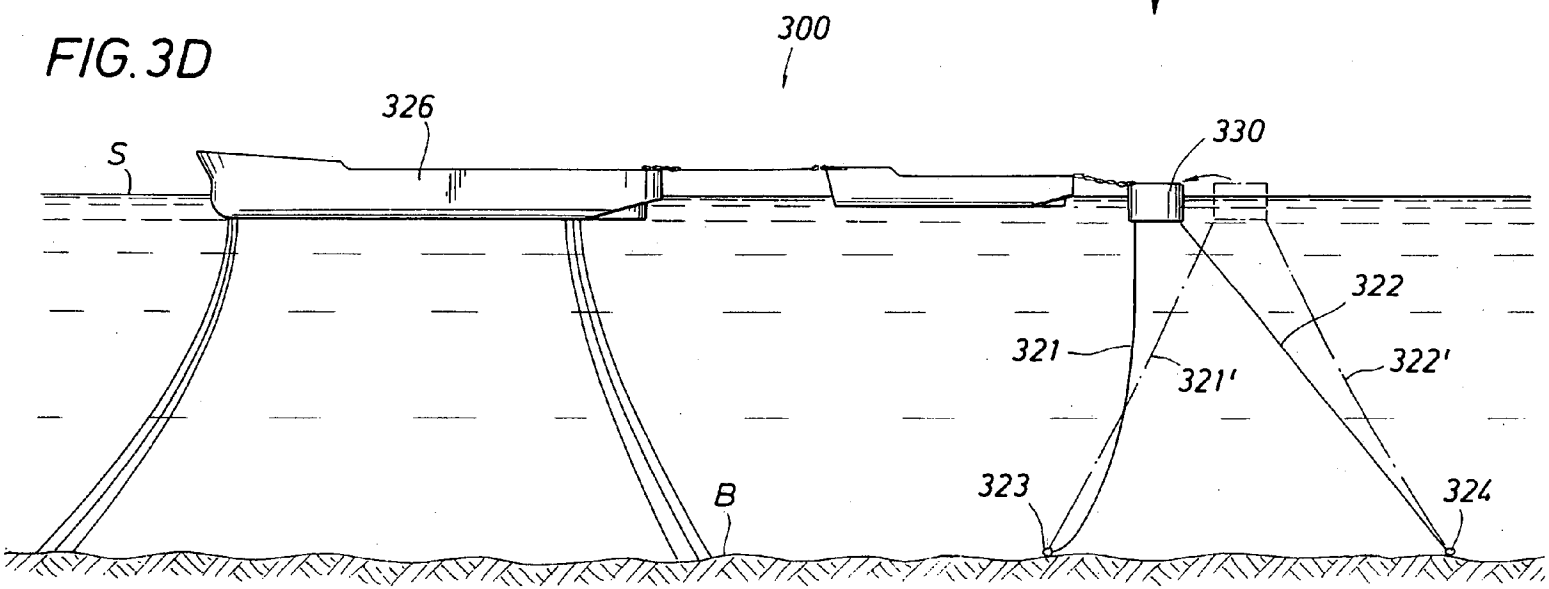

An alternative spread mooring arrangement 300' is shown in FIGS. 3C and 3D where a buoy or SALM 330 is moored by two mooring legs 321 and 322 which have anchor points 323 and 324 with the sea bottom B, the anchor points being in substantial alignment with the center-line 325 of a FPSO 326. This arrangement permits substantial environment compliant movement as evidenced by compliant arrows 327 and 328, while maintaining predetermined minimum spacing of the buoy 330 from the FPSO 326, sufficient for greater lateral movement of a shuttle tanker with respect to the FPSO 325. Mooring with one anchor leg positioned toward the FPSO 326 and a second anchor leg 322 directed away from the FPSO 326 provides for greater compliance in yaw and greater stiffness in surge.

Alternative configurations (not illustrated) to the arrangements of FIGS. 3A, 3B, 3C, 3D include, (1) single anchor leg (rather than the two diverging anchor legs shown in FIGS. 3A, 3B, and in FIGS. 3C, 3D in the desired direction of unloading for lower loads and greater compliance;

(2) A hold-back buoy 330 which is submerged in operating conditions; and (3) Multiple buoys, rather than the one hold back buoy of FIGS. 3A, 3B, or 3C, 3D with the FPSO anchor legs serving as multi-buoy connection points.

The spread mooring and FPSO offloading arrangement 400, in FIGS. 4A and 4B includes two mooring legs or groups of legs 401 and 402 between a single point mooring (SPM) terminal 403 to anchors 404 and 405 at the sea floor F, and a third mooring leg or groups of legs 406 connected to the FPSO 407. The mooring leg or groups of legs 406 includes one or more chains 408 which is (are) shorter than an unloading hose or riser 409 and consequently are located over the unloading flow lines or hoses 409. Alternatively, a single sea floor anchor leg group may be provided to the SPM buoy 403. In such case, the single mooring leg 406 and its anchor will be aligned with the center-line of the FPSO. A shuttle tanker 410 is tethered by a hawser 412 to the SPM 403 and product hoses extend from the SPM to the shuttle tanker 410 for controlled offloading of the FPSO.

The arrangement 400 of FIGS. 4A and 4B allows 360 degree weathervaning of the shuttle tanker 410 at a distance on the order of 10 times greater than in the case of prior art tandem offloading, but if placed at about 600 meters from the FPSO 407, the shuttle tanker 410 is less than one third of the 2000 m distance between the SPM and FPSO of current SPM terminal system designs. As a result, approach collision risk, offloading collision risk and offloading down time due to non-colinearity are all minimized. These advantages are achieved without, or with reduced, costly support tug assistance during unloading. Due to the reduced distance from the FPSO 407 to the SPM terminal 403 as compared with 2000 m distant SPM terminals, the flow lines are economically made of flexible material to eliminate fatigue concerns inherent in the larger diameter steel flow lines needed to keep head losses at reasonable levels with SPM terminals located 2000 m from the FPSO.

An alternative configuration to the spread mooring arrangement 400 illustrated in FIGS. 4A and 4B includes orientation of the SPM buoy 403 in the direction of the prevailing environment rather than being aligned with the centerline C/L of the FPSO or to the side of the FPSO to facilitate parallel approach in the case where the FPSO is aligned with the prevailing environment.

Figure 5A:
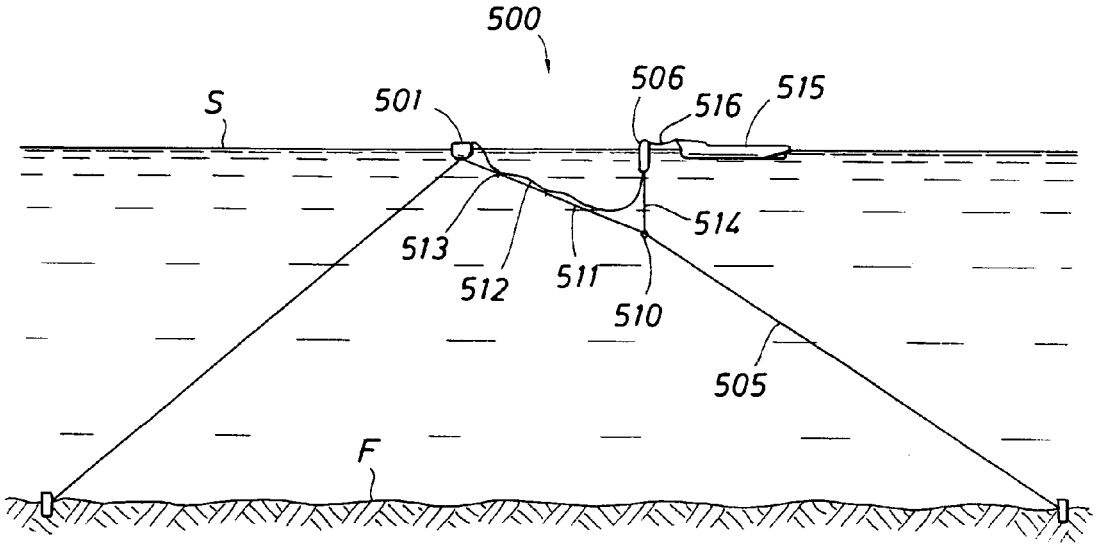
FIGS. 5A and 5B are side elevation and plan views of a SALM moored shuttle tanker tethered to one of the spread mooring anchor leg groups of a FPSO.
Figure 5B:
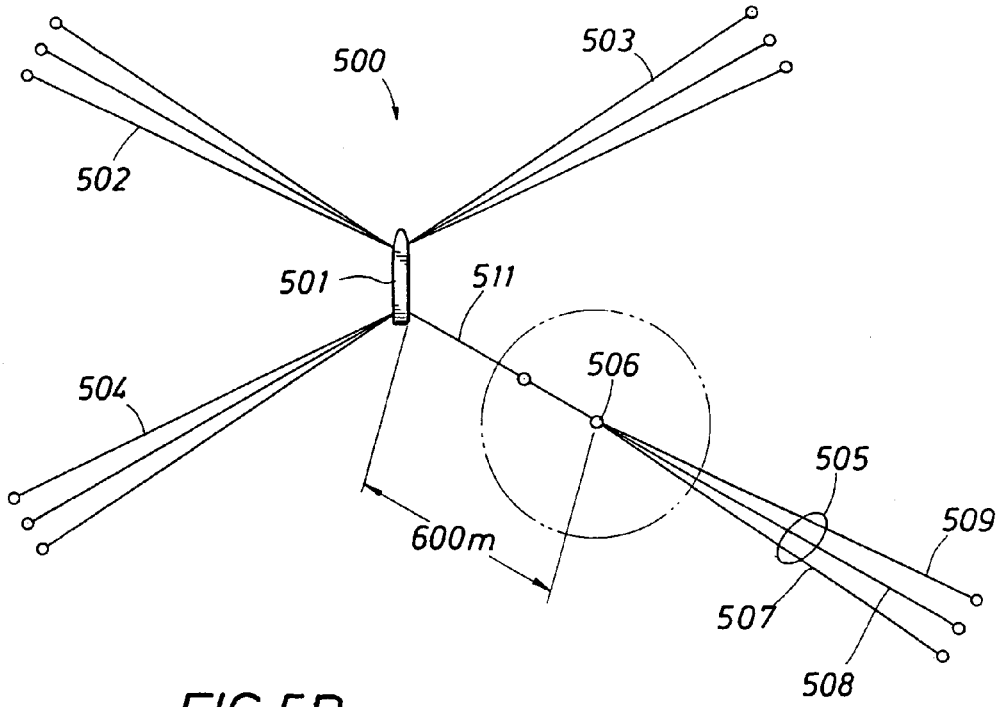

The spread mooring and FPSO offloading arrangement 500 in FIGS. 5A and 5B has a FPSO 501 that is moored by a plurality of mooring legs 502, 503, 504 and 505. A SPM terminal 506 in the form of a SALM is tethered to one of the spread moor anchor leg groups 505 at a distance somewhere between the extremes of tandem (80 m) and CALM (2000 m) distance connections. The mooring leg group 505 includes a plurality of mooring leg sections 507, 508 and 509 having ends thereof received by an intermediate mooring connector 510. The mooring connector 510 is linked to FPSO 501 by a single mooring line member or group of members 511 and is located at a distance of at least 600 m with respect to the FPSO 501. A mooring leg or multiple mooring legs 514 extends from the intermediate connector 510 to an appropriate mooring connection of the SPM terminal 506. A mooring hawser 516 establishes releasable mooring connection of the shuttle tanker 515 with the SPM terminal 506 and a product loading conduit 517, which may be in the form of a flexible hose, provides a rotatable fluid flow connection of the SPM terminal 506 with a loading manifold of the shuttle tanker 515. To permit 360 degree weathervane movement or rotation of a shuttle tanker 515 about the SPM buoy (or SALM) 506, the single mooring line or link or multiple of mooring lines or links 511 has a length in the order of about 600 m so that the maximum shuttle tanker weathervaning radius permits the shuttle tanker 515 to remain well clear of the FPSO regardless of its weathervaned position. A product flow line or hose 512 from the FPSO 501 to the terminal 506 is routed along the single mooring line or link or multiple of mooring lines or links 511 of the spread moor anchor leg 505 and may be secured to the single mooring line or link by a plurality of retainer elements 513.

The mooring link 514 is of a length such that the buoyancy of the SALM applies an upwardly directed force to the intermediate connector 510, thus stabilizing the location of the SALM 506 with respect to the FPSO 501 to ensure efficiently controlled positioning of the shuttle tanker 515 relative to the FPSO 501 under all conditions of environmental positioning.

The mooring arrangement of FIGS. 5A, 5B, similar to the FPSO tethered buoy of FIGS. 4A, 4B, allows weathervaning and approach distances far greater than traditional tandem offloading, with flexible fatigue resistant flow lines. These advantages are achieved without, or with reduced, costly support tug assist during unloading.

An alternative arrangement to that illustrated in FIGS. 5A, 5B includes mooring the SPM terminal from the anchor legs off to the side of the FPSO in the athwartships direction.

Figure 6B:
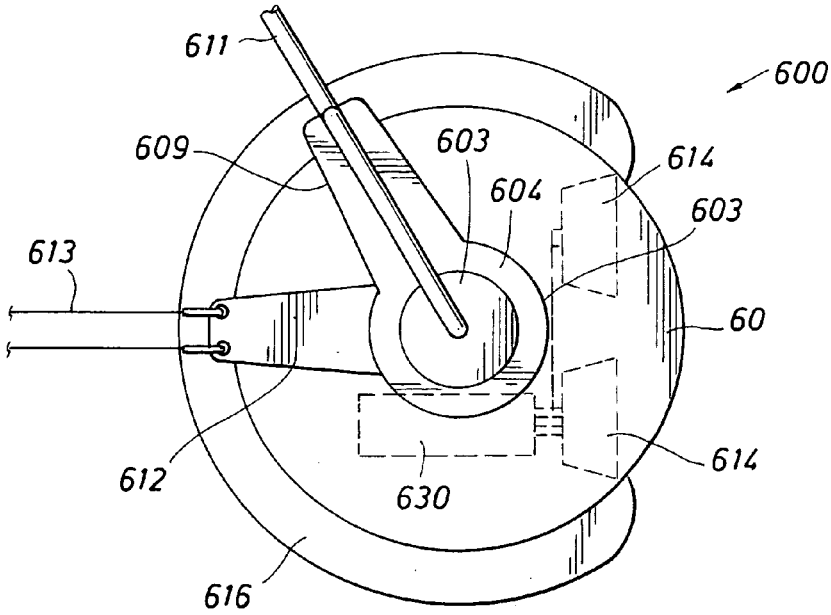
FIGS. 6A and 6B are side and plan views of a DP buoy with propulsion which can be dynamically positioned at a safe distance from the FPSO for mooring a shuttle tanker in offloading relation with the FPSO.
Figure 6A:
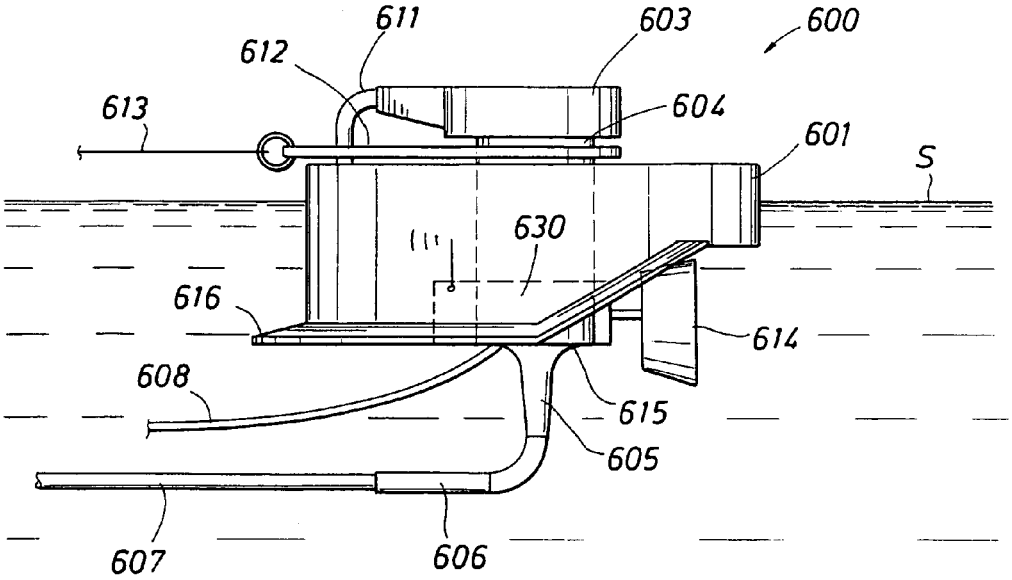

FIGS. 6A and 6B illustrate a Dynamically Positioned buoy, shown generally at 600, having an onboard propulsion system having sufficient directional controlled thrust for moving a shuttle tanker or for counteracting environmental forces. The DP buoy 600 is therefore capable of being dynamically positioned by its propulsion system at a selected distance from the FPSO 620, shown in the operational plan and elevational views of FIGS. 7A and 7B and thus permit control of the character and location of shuttle tanker mooring that is desired. The DP buoy 600 also permits the position of the shuttle tanker 617 to be controlled with respect to changes in the environment. The DP buoy 600 includes a buoyant body 601 which positions the buoy at the water surface S. A turn-table 603 having a rotary mounting section 604 is rotatably supported by the buoyant body 601, thus permitting the buoyant body 601 to be selectively rotatably positioned relative to the turn-table 603. The rotary mounting section 604 is of generally cylindrical configuration and has a lower conduit connector 605 having a connection extension 606 to which under-buoy FPSO product hoses 607 are connected. A catenary tether 608, which is preferably in the form of a mooring chain, is connected to an FPSO 620 and the DP buoy 600 and assumes a catenary configuration as shown in FIG. 7A to permit a weathervaning shuttle tanker 617 to pass over it in response to environmental changes. The submerged product hoses 607 have sufficient length to accommodate the minimum 600 m spacing of the buoy 600 from the FPSO 620 and to accommodate the catenary that is required to permit a shuttle tanker to pass over the product hoses 607 and the catenary tether 608.

The turntable 603 is provided with a hose connector extension 609 which provides for support, orientation and connection of floating hose 611 which extend to the loading manifold of a shuttle tanker 617 being moored from the buoy 600. One or more hawser members 613 are provided on a turntable extension 612 of the buoy 600 to permit connection of shuttle tanker hawsers 613 for mooring of a shuttle tanker 617 during FPSO 620 offloading and shuttle tanker 617 loading.

The DP buoy 600 is powered by twin z-drive propulsion units 614 that are locally controlled on the DP buoy 600 itself or are remotely controlled from the FPSO. Remote control units are schematically indicated by controller 630 with antennae for remote communication between FPSO and DP buoy as illustrated in FIGS. 6A and 7A. The catenary tether 608 of the DP buoy 600 to the FPSO is connected to an under buoy turntable 605, which also houses the connection of under buoy loading hoses 607. The shuttle tanker is moored through hawsers 613 to a deck-mounted turntable 603 and loaded through typical floating hose or hoses 611 connected to the same turntable assembly. The floating hoses 611 and under buoy hoses 606 fluidly communicate through a product swivel 615 located at the center of the body 601. The buoy 600 also includes one or more fenders 616 which provide protection for the buoy 600, the shuttle tanker 617 and the FPSO 620 in the event of contact.

In operation, the DP buoy 600 is free to weathervane about the FPSO 620 on its catenary tether 608 as evidenced by the buoy position arc 618 of FIG. 7B. The shuttle tanker 617 is, in turn, free for 360 degree weathervaning about the DP buoy 600 within a maximum shuttle tanker radius 619 that permits the shuttle tanker to pass over and well clear of the catenary tether 608 and the submerged FPSO product hoses 607 during weathervaning movement. As mentioned above, the DP buoy 600 is fitted with twin z-drive propulsion sets 614, which exert force away from the FPSO in the event of a sudden change in prevailing environment forces which might put the shuttle tanker 617 in jeopardy of collision or interference with the FPSO 620. Used with an FPSO having its mooring legs connected at keel level, the safe unloading zone of the FPSO 620 is increased from ±30 degrees to ±90 degrees, thereby minimizing the frequency and magnitude of DP buoy propulsion system use.

FIGS. 7C and 7D are elevational and plan views which illustrate positioning of the DP buoy 600 when it is not in use. After loading of a shuttle tanker has been completed, the shuttle tanker disconnects from its product loading connection and its mooring connection with the DP buoy. At this point, the propulsion system may be activated to move the buoy 600 from its operative position on the arc 618 to close proximity with the FPSO as shown in FIG. 7C, with the floating product loading hose or hoses 611 remaining on the water surface and available for connection with the next shuttle tanker to be loaded. Alternatively, the DP buoy may be deenergized, causing the weight induced forces of the catenary tether 608 and the submerged hose or hoses 607 to pull the DP buoy 600 to a position near the FPSO, with the catenary tether 608 and the submerged hose or hoses 607 settling toward the sea bottom and generally assuming the configuration shown in the elevational view of FIG. 7C.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A mooring arrangement (200) comprising, a floating storage vessel (210) having first and second ends and moored in deep water, a shuttle tanker (220), a submerged yoke (230) having first and second ends, with said first end of said yoke pendularly coupled to one of said first and second ends of said floating storage vessel (210) such that said second end of said yoke (230) is capable of swinging in a lateral arc (231) about said first end and said yoke is capable of swinging longitudinally with respect to the floating storage vessel, at least one buoyant vertical column (261) mounted on said submerged yoke (230), and at least one hawser (233) extending from said at least one buoyant vertical column (210) to said shuttle tanker (220).

2. The arrangement of claim 1 wherein, said at least one buoyant vertical column (261) is mounted on said yoke (230) toward said first end of said submerged yoke (230), and said at least one hawser (233) extends from said column (261) to a bow location of said shuttle tanker (220).

3. The arrangement of claim 1 further comprising, a second buoyant vertical column (262) mounted on said submerged yoke (230), and a second hawser (234) extending from said second buoyant vertical column (262) to said shuttle tanker (220).

4. The arrangement of claim 3 further including, a loading boom (272) mounted on said second buoyant vertical column (262), a manifold (220) disposed on said shuttle tanker (220), and a loading hose (280) extending between said loading boom (272) and said manifold (220) of said shuttle tanker (220).

5. A mooring arrangement (100, 200) comprising, a floating storage vessel (10, 210) having first and second vessel ends and moored in deep water, a shuttle tanker (20, 220), a submerged yoke (30, 230) having first and second yoke ends with said first yoke end connected to one of said first and second floating storage vessel ends by a pendular arrangement (15, 215) so that said yoke (30, 230) is capable of swinging in a lateral arc (A1, 231) about said one of said first and second floating storage vessel ends and is capable of swinging longitudinally with respect to said floating storage vessel, at least one buoyant member (26, 261) connected to said submerged yoke (30, 230), and at least one coupling member (28, 233) connecting said at least one buoyant member (26, 261) to said shuttle tanker (20, 220).

6. The mooring arrangement of claim 5 wherein, said pendular arrangement (15, 215) includes a chain and said first end of said yoke is capable of twisting with respect to said one of said first and second vessel ends so that said yoke (30, 230) buoyant member (26, 261), coupling member (28, 233), and shuttle tanker (220) are capable of swinging in said lateral arc with respect to said one of said first and second vessel ends.

7. The mooring arrangement of claim 5 wherein, said buoyant member is a buoyant vertical column (261) mounted on said submerged yoke (230).

8. The mooring arrangement of claim 5 wherein, said buoyant member is a buoyant column (261) mounted on said submerged yoke (230).

9. The mooring arrangement of claim 8 further comprising a second buoyant column (262) mounted on said submerged yoke (230), and a second coupling member (234) connected between said second buoyant column (262) and said shuttle tanker (220).

10. The mooring arrangement of claim 9 further including, a loading boom (272) mounted on said second buoyant colunm (262), a manifold (270) disposed on said shuttle tanker (220), and a loading hose (280) connected between said loading boom (272) and said manifold (270).

11. A mooring arrangement (100, 200) comprising a floating storage vessel, a shuttle tanker, a submerged yoke having first and second ends with said first end connected to said floating storage vessel by flexible tension members so that said yoke is capable of swaying and twisting with respect to said storage vessel with the yoke being able to move longitudinally and in a lateral arc with respect to said floating storage vessel, at least one buoyant member connected to said submerged yoke, and a coupling member connected between said submerged yoke and said shuttle tanker.

12. A mooring arrangement (100) comprising, a floating storage vessel (10) having first and second vessel ends and moored in deep water, a shuttle tanker (20), a submerged yoke (30) having first and second yoke ends with said first yoke end connected to one of said first and second vessel ends by a pendular arrangement (15) 50 that said yoke (30, 230) is capable of swinging in a lateral arc (A1, 231) about said one of said first and second vessel ends, a SALM buoy (26) connected to said submerged yoke (30), by a flexible tension member (25), and at least one coupling member (28) connecting said SALM buoy (26) to said shuttle tanker (20), whereby said shuttle tanker is capable of swinging in a lateral arc with respect to said one of said first and second vessel ends.

* * * * *

UNITED STATES PATENT AND TRADEMARK OFFICE

CERTIFICATE OF CORRECTION

PATENT NO. : 6,983,712 B2
DATED : January 10, 2006
INVENTOR(S) : Roy H. Cottrell et al.

It is certified that error appears in the above-identified patent and that said Letters Patent is hereby corrected as shown below:

Column 2,
Line 67, delete “form” and insert -- from --.

Column 13,
Line 14, before “column” insert -- vertical --.

Column 14,
Line 14, delete “50”, and insert -- so --.

Signed and Sealed this

Twenty-fifth Day of April, 2006

JON W. DUDAS
*Director of the United States Patent and Trademark Office*